US006296510B1

(12) United States Patent
Daniels et al.

(10) Patent No.: US 6,296,510 B1
(45) Date of Patent: Oct. 2, 2001

(54) ELECTRICAL CONNECTOR WITH LEVER TYPE LATCH MEANS

(75) Inventors: Marlon Daniels, Oak Park; Fred Jaklic, Brookfield; Bill Blake Wilson, Montgomery, all of IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/658,818

(22) Filed: Sep. 11, 2000

(51) Int. Cl.[7] ..... H01R 13/62; H01R 13/64
(52) U.S. Cl. ..... 439/372
(58) Field of Search ..... 439/372, 157, 439/152, 153, 160

(56) References Cited

U.S. PATENT DOCUMENTS 5,135,408 * 8/1992 Suzuki ..... 439/372
5,308,255 * 5/1994 Yamanashi ..... 439/157
5,401,179 * 3/1995 Shinchi et al. ..... 439/157
5,873,745 * 2/1999 Duclos et al. ..... 439/157
5,904,583 * 5/1999 Katsuma et al. ..... 439/157

* cited by examiner

*Primary Examiner*—Brian Sircus
*Assistant Examiner*—Javaid Nasri
(74) *Attorney, Agent, or Firm*—Stacey E. Caldwell

(57) ABSTRACT

A lever type electrical connector assembly includes a first connector having an actuating lever pivotally movably mounted thereon for movement between a preload position and a mating position. The actuating lever includes a cam groove formed therein. A latch is provided between the first connector and the actuating lever for holding the actuating lever in the preload position. A second connector includes a cam follower projection to be engaged in the cam groove of the actuating lever, whereby the connectors are mated and unmated in response to rotation of the actuating lever. A release is provided on the second connector for releasing the latch automatically as the connectors are mated to allow the actuating lever to move from the preload position to the mating position.

14 Claims, 4 Drawing Sheets

ELECTRICAL CONNECTOR WITH LEVER TYPE LATCH MEANS

FIELD OF THE INVENTION

This invention generally relates to the art of electrical connectors and, particularly, to an electrical connector having a lever whereby mating and unmating of the connector with a second connector is effected by rotation of the lever.

BACKGROUND OF THE INVENTION

A typical lever type electrical connector assembly includes a first connector which has an actuating lever rotatably mounted thereon for connecting and disconnecting the connector with a complementary mating second connector. The actuating lever and the second connector typically have a cam groove/cam follower arrangement for drawing the second connector into mating condition with the first connector in response to rotation of the lever.

A common structure for a lever type electrical connector of the character described above is to provide a generally U-shaped lever structure having a pair of lever arms which are disposed on opposite sides of the first ("actuator") connector. The lever arms may have cam grooves for engaging cam follower projections or posts on opposite sides of the second ("mating") connector.

Such lever type connectors often are used where large forces are required to mate and unmate a pair of connectors. For instance, terminal and housing frictional forces encountered during connecting and disconnecting the connectors may make the process difficult to perform by hand. The present invention is directed to solving various problems with such connectors, including providing means for protecting the lever system from damage or breakage. In particular, if the actuating lever is not in a properly aligned "preload" position, attempts to forcibly mate the connectors can cause damage or breakage to the lever or other operative components. The present invention provides a system for latching the actuating lever is a preload position to ensure that the cam grooves and cam follower projections are properly aligned. The latch means prevents the actuating lever from being disengaged during shipping and handling, and the lever is automatically unlatched upon mating of the connectors.

SUMMARY OF THE INVENTION

An object, therefore, of the invention is to provide a new and improved lever-type electrical connector assembly.

In the exemplary embodiment of the invention, a first connector pivotally mounts an actuating lever for movement between a preload position and a mating position. The actuating lever includes a cam groove therein. Complementary interengaging latch means are provided between the first connector and the actuating lever for holding the lever in the preload position. A second connector includes a cam follower projection to be engaged in the cam groove of the actuating lever, whereby the connectors are mated and unmated in response to rotation of the actuating lever. Release means are provided on the second connector for releasing the latch means automatically as the connectors are mated to allow the actuating lever to move from the preload position to the mating position. The cam groove of the lever includes a mouth which is in alignment with the cam follower projection when the lever is in the preload position.

According to one aspect of the invention, the actuating lever comprises one arm of a generally U-shaped lever structure having a pair of actuating arms pivotally mounted on opposite sides of the first connector. A pair of the cam follower projections are provided on opposite sides of the second connector. The pair of actuating arms are joined by a cross portion. The complementary interengaging latch means are operatively associated with the cross portion.

According to another aspect of the invention, the complementary interengaging latch means comprise a flexible latch member on the actuating lever engageable with a latch shoulder on the first connector. The release means include a release member on the second connector engageable with the flexible latch member to bias the latch member out of engagement with the latch shoulder. The release member is formed by a ramped projection on the second connector. The latch shoulder is on a ramped latch boss on the first connector and behind which the flexible latch member resiliently snaps into latching engagement.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
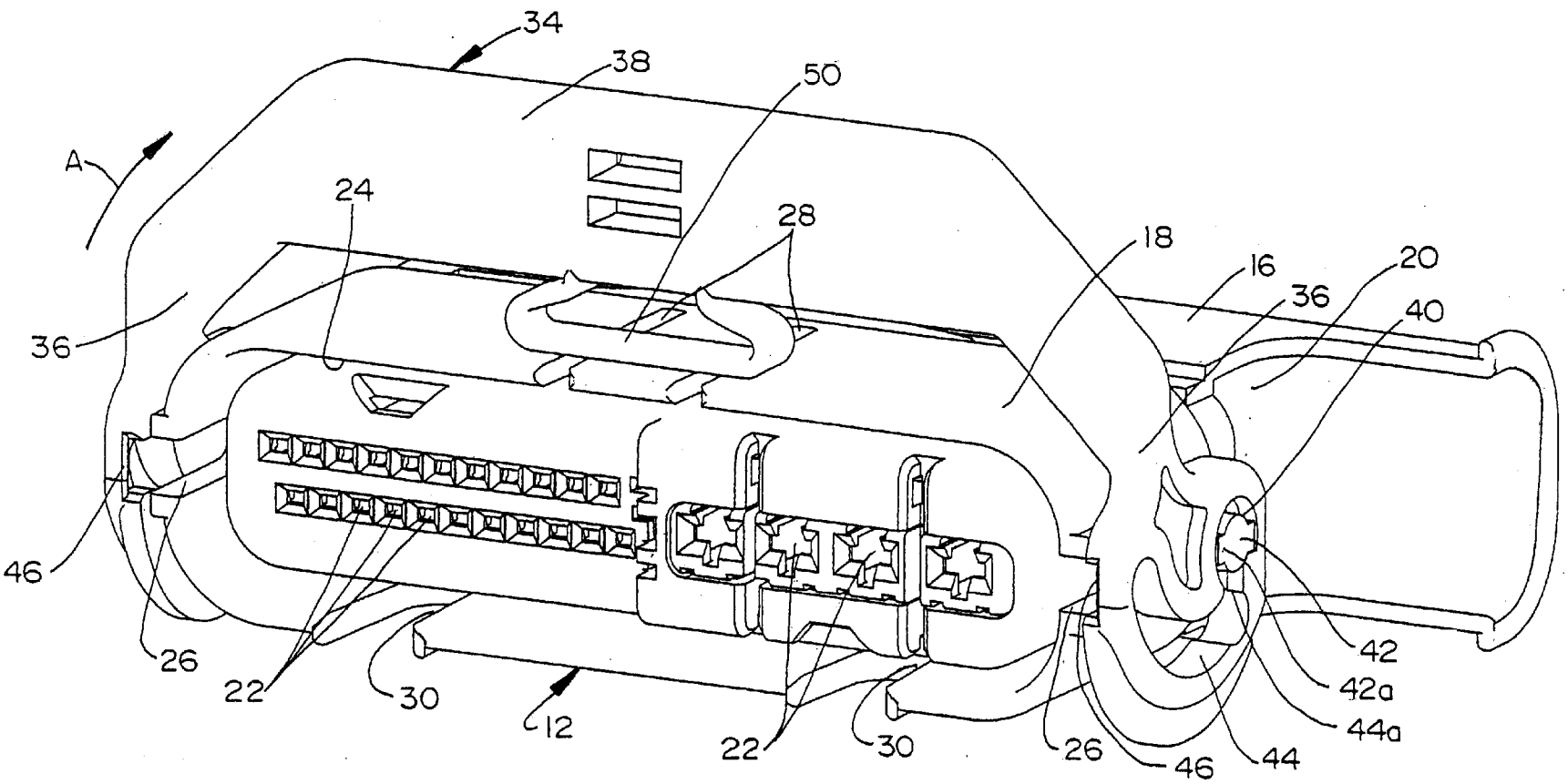
FIG. 1 is a perspective view of the actuator connector looking at the mating end thereof, with the actuating lever in its preload position.
Figure 2:
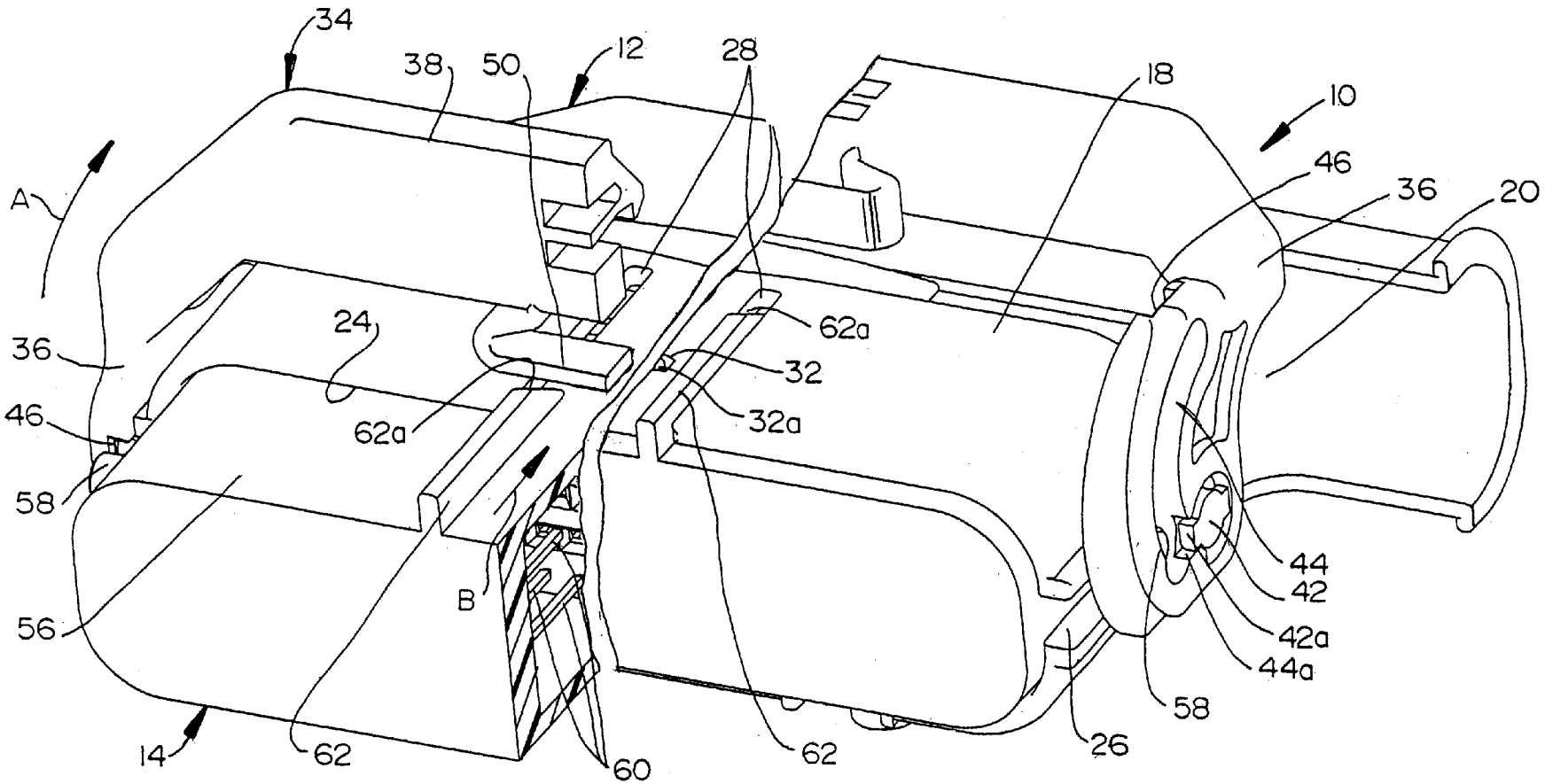
FIG. 2 is a perspective view similar to that of FIG. 1, with the mating connector added, and with the right-hand half of the figure showing the actuating lever moved to its mating position drawing the mating connector into its mating condition.

Referring to the drawings in greater detail, and first to FIGS. 1 and 2, the invention is embodied in a lever-type electrical connector assembly, generally designated 10 (FIG. 2). The assembly includes a first ("actuator") connector, generally designated 12, and a second ("mating") connector, generally designated 14. The actuator connector is shown in FIG. 1, and the mating connector is shown in conjunction with the actuator connector in FIG. 2. FIG. 2 is broken in the center thereof to show mating connector 14 on the left-hand side of the depiction in unmated condition and on the right-hand side of the depiction in mated condition.

Actuator connector 12 is elongated and includes a shroud or cover 16 which covers the top thereof and combines with a housing 18 of the connector to provide an end opening 20 for ingress/egress of an electrical cable (not shown) having conductors terminated to terminals within a plurality of terminal-receiving passages 22 of the housing. The housing has an elongated receptacle 24 for receiving mating connector 14. Housing 18 has a pair of grooves 26 in the opposite ends or minor shorter sides thereof and a pair of grooves 28 in one major longer side thereof, for purposes to be described hereinafter. A pair of polarizing slots 30 are provided in the opposite major side of the housing for receiving a pair of polarizing ribs (not shown) on mating connector 14. Finally, as seen in FIG. 2, a ramped latch boss 32 defining a latch shoulder 32*a* projects from the outside of housing 18 between grooves 28.

A generally U-shaped lever structure, generally designated 34, is pivotally mounted on housing 18 of actuator connector 12. The lever structure is rotatable upwardly in the direction of arrows "A" as viewed in FIGS. 1 and 2 to draw mating connector 14 into mated condition with the actuator connector. The U-shaped lever structure defines a pair of levers or actuating arms 36 joined by a cross portion 38 which generally spans the length of the actuator connector. Each actuating arm has a pivot aperture or journal 40 for receiving a pivot boss 42 projecting outwardly from housing 18. Each actuating arm has an eccentric, arcuate cam groove 44 which extends from pivot aperture 40 to an outer mouth 46. Outer mouth 46 can also include detents (not shown) that correspond to projections (not shown) in the mating connector to allow the mating connector to be preloaded onto the actuator connector. This preload condition of the mating connector can be very advantageous in many applications. It can be seen in FIG. 1 that mouths 46 are aligned with grooves 26 in housing 18 when the lever structure is in its preload position, as shown. Each groove 44 has an inner mouth 44*a* for receiving a detent 42*a* of pivot boss 42 when the lever structure is in a mating position as shown at the right-hand side of FIG. 2. Detent 42*a* can snap into and out of mouth 44*a*.

Figure 3:
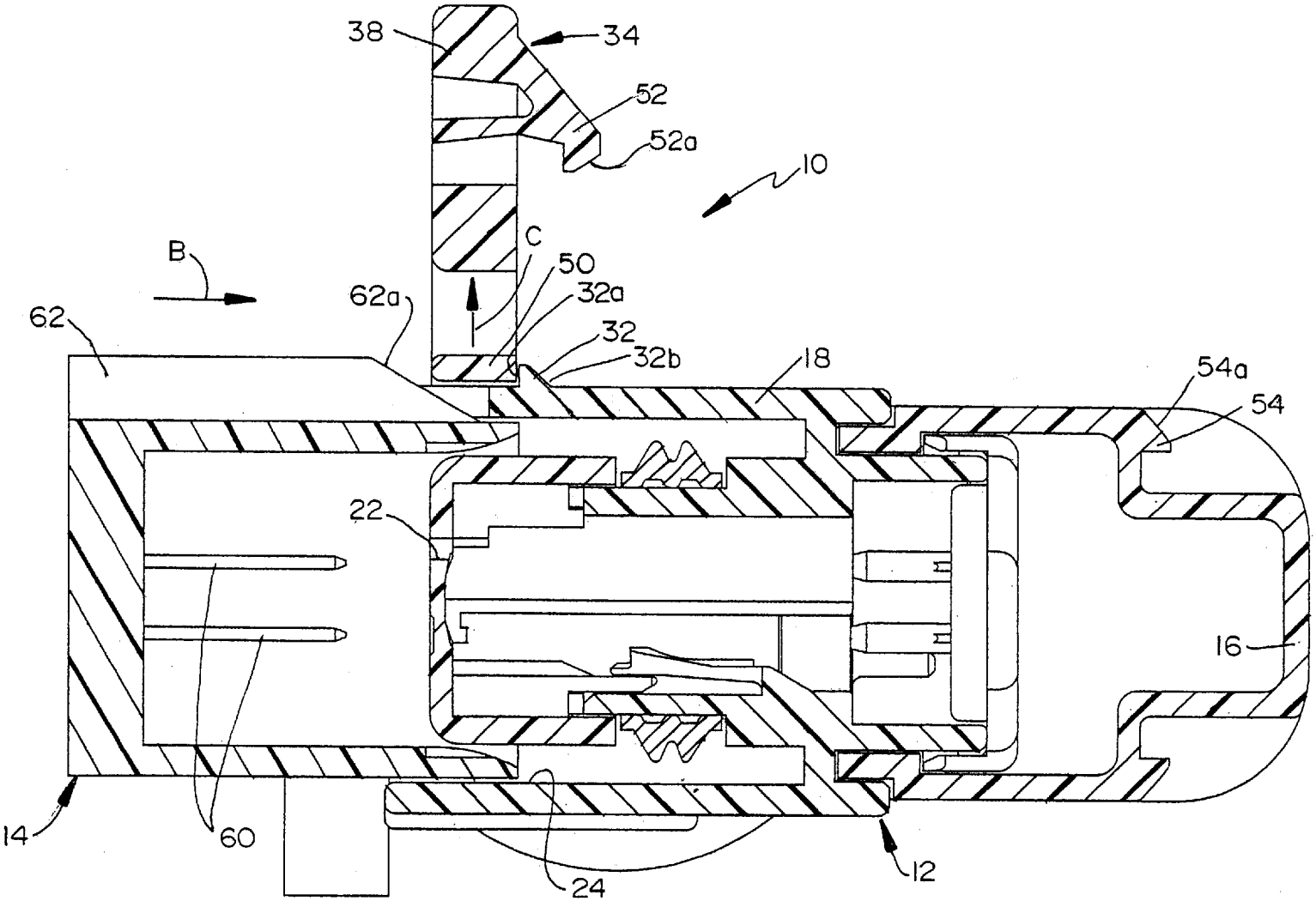
FIG. 3 is a side elevational view of the electrical connector assembly including the actuator connector and the mating connector, with the actuating lever in its preload position, with the mating connector about to be inserted into the actuator connector and with the terminals of the actuator connector removed.

Generally, complementary interengaging latch means are provided between housing 18 of actuator connector 12 and lever structure 34 for holding the lever structure in its preload position shown in FIG. 1 and at the left-hand side of FIG. 2. More particularly, the lever structure may be unitarily molded of plastic material and includes a flexible latch member or bridge 50 integral with cross portion 38 of lever structure 34. FIG. 3 shows flexible bridge 50 latched behind latch shoulder 32*a* of latch boss 32 on connector housing 18, with lever structure 34 in its preload position. FIG. 3 also shows that latch boss 32 has a ramped side 32*b* opposite latch shoulder 32*a* to allow for flexible bridge 50 to easily ride over the latch boss and snap into latching engagement with latch shoulder 32.

Figure 4:
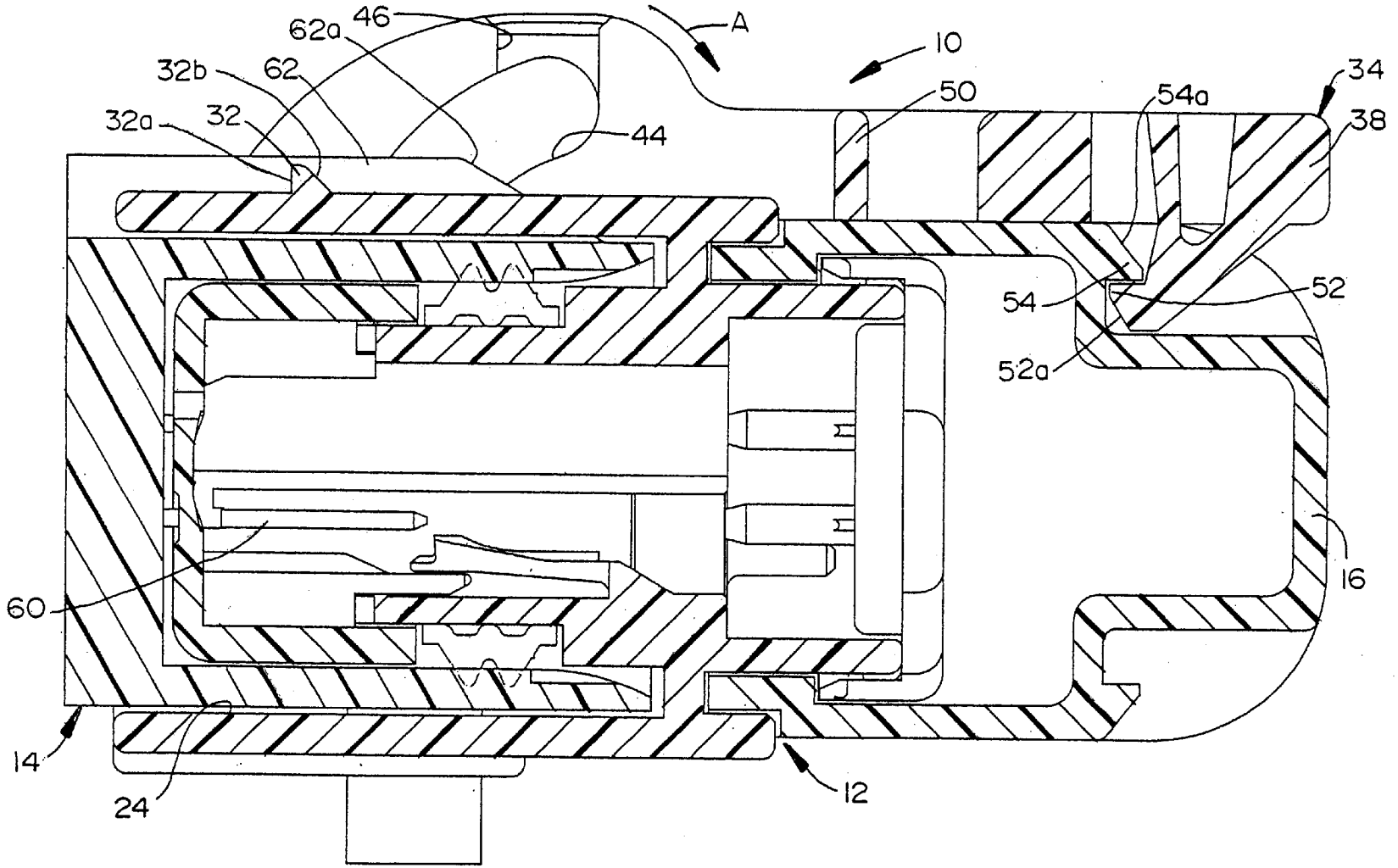
FIG. 4 is a view similar to that of FIG. 3, with the actuating lever in its mating position and the mating connector fully mated.

FIG. 4 shows lever structure 34 having been rotated in the direction of arrow "A" to a mating position. The lever structure includes a second latch 52 engageable with a latch portion 54 of shroud 16 to hold the lever structure in its mated position. Latches 52 and 54 have ramped surfaces 52*a* and 54*a*, respectively, to allow for easy snapping engagement of the latches. Latch 52 can also include a thumb release button (not shown) for facilitating or expediting disengagement of the latches.

Mating connector 14 (FIG. 2) includes a housing 56 having a cam follower projection 58 projecting outwardly of opposite ends or minor sides thereof. When lever structure 34 is in its preload position as shown in FIG. 1 and the left-hand side of FIG. 2, cam follower projections 58 are aligned with grooves 26 (FIG. 1) in housing 18 of actuator connector 12. The cam follower projections also are in alignment with mouths 46 of cam grooves 44 in actuating arms 36 of lever structure 34. The mating connector includes a plurality of terminal pins 60 (FIG. 2) for insertion into terminal-receiving passages 22 (FIG. 1) of actuator connector 12.

Generally, release means are provided on mating connector 14 for releasing latch bridge 50 from behind latch shoulder 32*a* of actuator connector 12 automatically as the connectors are mated. This allows the lever structure to be moved from its preload position to its mating position. Specifically, a pair of release ribs 62 project outwardly from the side of housing 56 of mating connector 14 facing lever structure 34. The release ribs have inclined or ramped inner ends 62*a*.

In operation of the latch and release system of the invention, mating connector 14 is mated with actuator connector 12 by inserting the mating connector into receptacle 24 of the actuator connector in the direction of arrows "B " (FIGS. 2 and 3). As the connectors are mated, ramped ends 62*a* of release ribs 62 engage flexible latch bridge 50 and bias the bridge upwardly in the direction of arrow "C" (FIG. 3) until the latch bridge clears latch shoulder 32*a* of latch boss 32. Lever structure 34 then is free to be pivoted from its preload position shown in FIG. 3 to its mated and latched position shown in FIG. 4. During rotation of the lever structure, cam follower projections 58 which have entered mouths 46 of cam grooves 44 ride in the eccentric cam grooves to draw mating connector 14 to its mated position shown at the right-hand side of FIG. 2 as well as in FIG. 4.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A lever type electrical connector assembly, comprising:

a first connector;

an actuating lever pivotally movably mounted on the first connector for movement between a preload position and a mating position and including a cam groove therein;

complementary interengaging latch means between the first connector and the actuating lever for holding the actuating lever in said preload position;

a second connector having a cam follower projection to be engaged in the cam groove of the actuating lever whereby the connectors are mated and unmated in response to rotation of the actuating lever;

said cam groove of said actuating lever including a mouth which is in alignment with the cam follower projection when the actuating lever is in said preload position; and release means on the second connector for releasing said latch means automatically as the connectors are mated to allow the actuating lever to move from the preload position to the mating position.

2. The lever type electrical connector assembly of claim 1 wherein said actuating lever comprises one of a pair of actuating arms of a generally U-shaped lever structure pivotally mounted on opposite sides of the first connector, and including a pair of said cam follower projections on opposite sides of the second connector.

3. The lever type electrical connector assembly of claim 2 wherein said pair of actuating arms are joined by a cross portion, and said complementary interengaging latch means are operatively associated with the cross portion.

4. The lever type electrical connector assembly of claim 1 wherein said complementary interengaging latch means comprise a flexible latch member on the actuating lever engageable with a latch shoulder on the first connector.

5. The lever type electrical connector assembly of claim 4 wherein said release means comprise a release member on the second connector engageable with said flexible latch member to bias the latch member out of engagement with said latch shoulder.

6. The lever type electrical connector assembly of claim 5 wherein said release member comprises a ramped projection on the second connector.

7. The lever type electrical connector assembly of claim 4 wherein said latch shoulder is on a ramped latch boss on the first connector and behind which the flexible latch member resiliently snaps into latching engagement.

8. A lever type electrical connector assembly, comprising:

a first connector;

a generally U-shaped lever structure having a pair of actuating arms pivotally mounted on opposite sides of the first connector for movement between a preload position and a mating position, each actuating arm having a cam groove with an open mouth, and the actuating arms being joined by a cross portion;

complementary interengaging latch means between the first connector and the cross portion of the lever structure for holding the lever structure in said preload position;

a second connector having a pair of cam follower projections on opposite sides thereof to be engaged in the cam grooves in said actuating arms, the cam follower projections being in alignment with the open mouths of the cam grooves when the lever structure is in said preload position, whereby the connectors are mated and unmated in response to rotation of the lever structure; and release means on the second connector for releasing said latch means automatically as the connectors are mated to allow the lever structure to move from the preload position to the mating position.

9. The lever type electrical connector assembly of claim 8 wherein said complementary interengaging latch means comprise a flexible latch member on the cross portion of the lever structure engageable with a latch shoulder on the first connector.

10. The lever type electrical connector assembly of claim 9 wherein said release means comprise a release member on the second connector engageable with said flexible latch member to bias the latch member out of engagement with said latch shoulder.

11. The lever type electrical connector assembly of claim 10 wherein said release member comprises a ramped projection on the second connector.

12. The lever type electrical connector assembly of claim 9 wherein said latch shoulder is on a ramped latch boss on the first connector and behind which the flexible latch member resiliently snaps into latching engagement.

13. The lever type electrical connector assembly of claim 8, including a second complementary interengaging latch means between the cross portion of the lever structure and the first connector to hold the lever structure in said mating position.

14. The lever type electrical connector assembly of claim 13 wherein said second latch means is operatively associated with a cover portion of the first connector.

* * * * *